US005842321A

United States Patent [19]

Jones

[11] Patent Number: 5,842,321

[45] Date of Patent: Dec. 1, 1998

[54] SYSTEM AND APPARATUS FOR FILLING AND CAPPING A VIAL

[75] Inventor: Dallas Hurl Jones, Knoxville, Tenn.

[73] Assignee: Advanced Mechanical Technologies, Inc., Knoxville, Tenn.

[21] Appl. No.: 890,541

[22] Filed: Jul. 9, 1997

Related U.S. Application Data

[60] Provisional application No. 60/023,477 Aug. 6, 1996.

[51] Int. Cl.[6] ..... B65B 3/10; B65B 7/28; B67B 1/04; B67B 3/22

[52] U.S. Cl. ..... 53/281; 53/284.6; 53/316; 53/319; 53/329; 53/390; 141/371

[58] Field of Search ..... 53/314, 316, 330, 53/281, 284.6, 471, 474, 489, 390, 319, 282; 141/102, 177, 237, 371

[56] References Cited

U.S. PATENT DOCUMENTS

| | | | |
|---|---|---|---|
| 2,821,823 | 2/1958 | Wahl | 53/316 X |
| 2,942,395 | 6/1960 | Thoren | 53/316 |
| 3,214,887 | 11/1965 | Weller | 53/316 |
| 3,261,142 | 7/1966 | Wilcox | 53/316 X |
| 4,098,058 | 7/1978 | Carrigan et al. | 53/314 X |
| 4,835,943 | 6/1989 | Mueller | 53/316 X |

*Primary Examiner*—Horace M. Culver
*Attorney, Agent, or Firm*—Luedeka, Neely & Graham, P.C.

[57] ABSTRACT

A system and apparatus for filling a plurality of vials, and for securing respective caps on each vial securely mounting a plurality of caps on, and filing with a substance, a plurality of vials. A guidance apparatus is provided that has a guide member with a T-shaped track mounted thereon and an traverse carriage having a T-shaped channel formed therein. The traverse carriage further includes two opposingly spaced and offset apertures for receiving the substance therethrough. The two opposingly spaced and offset apertures are each in axial alignment with one of the plurality of vials at the set points as the traverse carriage is slid along the guide member for filing two of the plurality of vials at each of the set points with the substance. A capping apparatus is also included that has two opposingly spaced side walls, and a track mounted between the base and side walls for slidably receiving the plurality of vials. A wheel is rotationally mounted between the two side walls for simultaneously sliding the plurality of vials along the track and securely mounting the plurality of caps on the plurality of vials when the wheel is rotated and contacts at least one of the plurality of caps.

18 Claims, 4 Drawing Sheets

SYSTEM AND APPARATUS FOR FILLING AND CAPPING A VIAL

CROSS-REFERENCE TO RELATED APPLICATIONS

This application claims the benefit of co-pending provisional application 60/023,477 filed Aug. 6, 1996.

BACKGROUND

1. Field of the Invention

In general, the present invention relates to vial processing technology and, in particular, the present invention relates to a system, guidance apparatus, and capping apparatus for securely mounting a plurality of caps on, and filling a plurality of vials.

2. Background of the Invention

Many modern day industries, and in particular the respiratory treatment fluid section of the medical industry, are presented with the challenges of filling, capping, and packaging large numbers of vials. Packaging of the vials must be done quickly and efficiently. Under current practices, an operator or lab technician is required to individually fill a large number of vials with a substance and then must use a great amount of hand force in applying caps to each of the vials to secure the substance within the vials for shipping. This type of packaging operation has proven to be costly, inefficient, requires a great deal of manual labor, and may result in some of the caps not being securely mounted on the vials.

SUMMARY OF THE INVENTION

The present invention eliminates the above difficulties and disadvantages of the prior art by providing a system, a guidance apparatus for filing at least one vial with a substance, and a capping apparatus for securely mounting a plurality of caps on the at least one vial. A carriage is provided for holding and transporting the at least one vial. The guidance apparatus has a guide member with a T-shaped track mounted thereon which forms two opposingly spaced grooves. The guidance apparatus further includes a traverse carriage that has a T-shaped channel formed therein and is defined by two opposingly spaced flanges for slidably engaging the two opposingly spaced grooves and for slidably moving the traverse carriage to set points along the guide member. The traverse carriage further includes two opposingly spaced and offset apertures for receiving the substance therethrough. The two offset apertures are each in axial alignment with one of the plurality of vials positioned in respective sockets in the carriage at set points as the traverse carriage is slid along the guide member for filling two of the plurality of vials with the substances at each set point along the traverse carriage. The capping apparatus has two opposingly spaced side walls, and a track mounted between the side walls for slidably receiving the plurality of vials. The capping apparatus further includes a wheel that is rotationally mounted between the two side walls for simultaneously sliding the plurality of vials along the track and securely mounting the plurality of caps on the plurality of vials when the wheel is rotated and contacts at least one of the plurality of caps.

A carriage is also provided in the present invention that has a plurality of aligned receptacles, wherein the vials are preferably disposed. This carriage is slid along the track when the wheel is rotated to contact at least one of the caps. A hand crank is also preferably attached to the wheel for manually rotating the wheel. The track further includes at least one conveyor or carrier roller rotationally mounted between the side walls of the capping apparatus for sliding the plurality of vials along the track. The guidance apparatus further includes a base wherein the guide member is mounted. The base has opposingly spaced abutment members forming a receiving edge therebetween. When the vials are being filled with the substance, the carriage abuts, and is equal in length to, the receiving edge. A stop member is also disposed in one of the opposingly spaced grooves of the guidance apparatus at each end of the guide member.

Other objects, features and advantages of the present invention will become apparent by reference to the following detailed description when considered in conjunction with the accompanying drawings.

DESCRIPTION OF THE PREFERRED EMBODIMENT(S)

Figure 1:
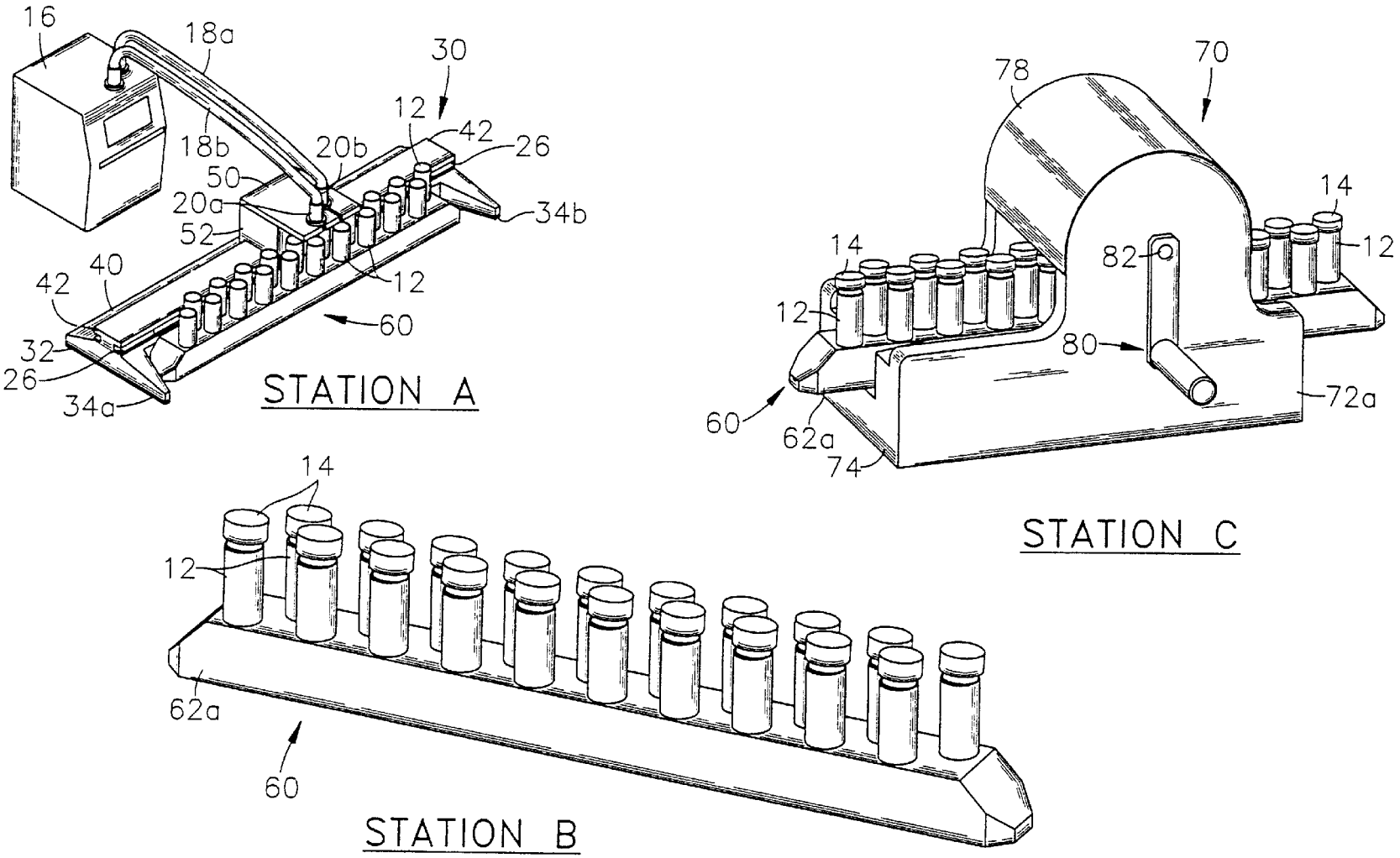
FIG. 1 is a perspective view of a system for securely mounting a plurality of caps on, and filling with a substance, a plurality of vials of the present invention.
Figure 2:
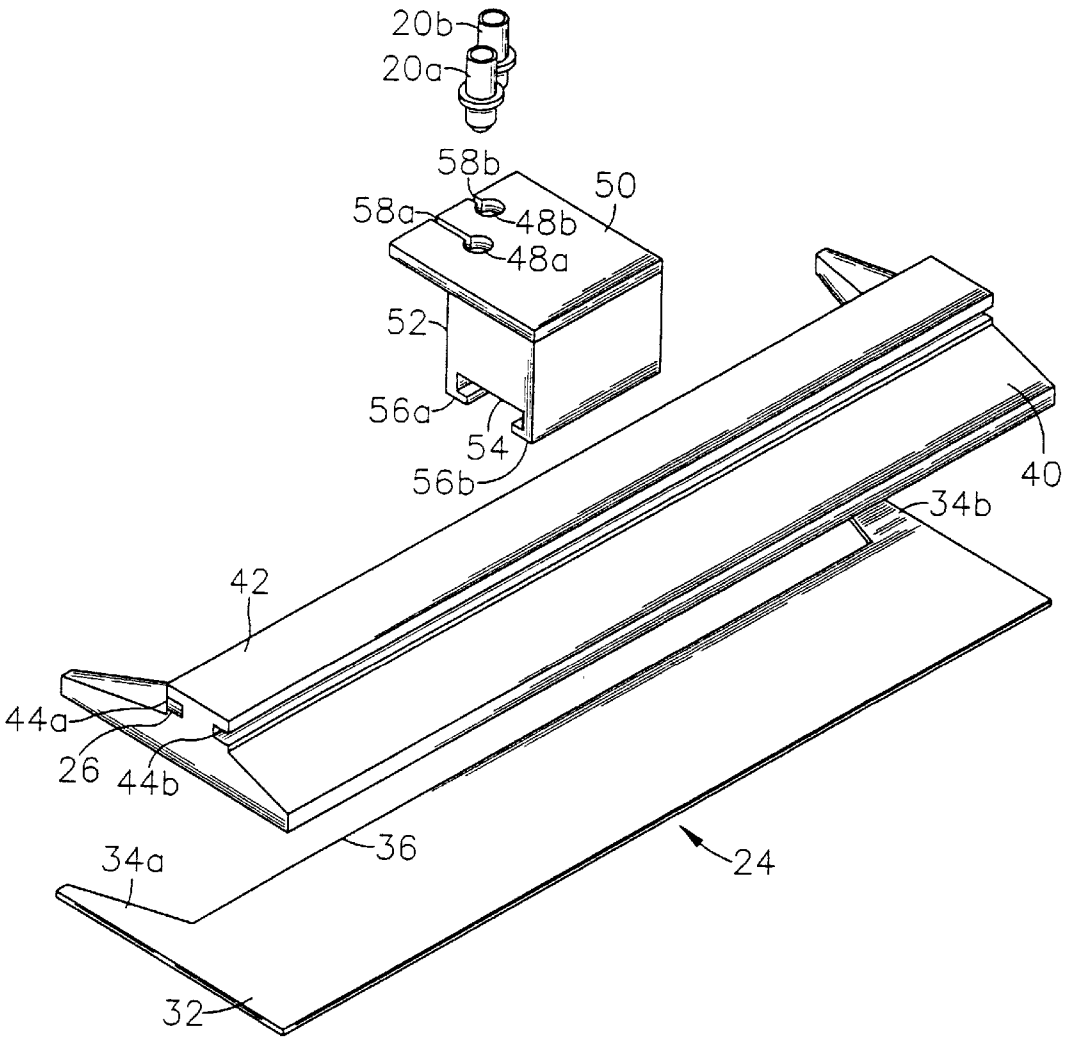
FIG. 2 is an exploded view of a guidance apparatus of the present invention.

Commencing with FIG. 1, a system 10 for securely mounting a plurality of caps 14 on a plurality of vials 12 as well as filling the vials 12 with a substance, is shown. Referring with particularity to "Station A" of FIG. 1 and FIG. 2, a guidance apparatus 30 is shown, which aids an operator in filling the plurality of vials 12 with the substance. A pumping device 16 is provided for transferring the substance, which is preferably respiratory treatment fluid, but can also be any other type of fluid or non-liquid substance. The pumping device 16 transfers the substance through conduits 18*a* and 18*b*, which is then transferred to at least one of the vials 12. Fastened to the conduits 18*a* and 18*b*, near the guidance apparatus 30, are nozzles 20*a* and 20*b*. The guidance apparatus 30 includes a guide member 40 that has a T-shaped track 42 mounted thereon and which forms two opposingly spaced grooves 44*a* and 44*b*. The guidance apparatus 30 further includes a traverse carriage 50 that has a T-shaped channel 54 formed therein. The T-shaped channel 54 is defined by two opposingly spaced flanges 56*a* and 56*b* for slidably engaging the two opposingly spaced grooves 44*a* and 44*b*. Once the opposingly spaced flanges 56*a* and 56*b* slidably engage the two opposingly spaced grooves 44*a* and 44*b* axial movement of the traverse carriage 50 to set points along the guide member 40 by the operator is enabled.

The traverse carriage 50 further includes two opposingly spaced and offset apertures, wherein nozzles 20*a* and 20*b* are disposed, for receiving the substance therethrough. The two opposingly spaced and offset apertures 48*a* and 48*b* are each in axial alignment with one of the plurality of vials 12 at set points along the T-shaped track 42 as the traverse carriage 50 is slid along the guide member 40 for filling two of the vials 12 at each of the set points with the substance.

Figure 3A:
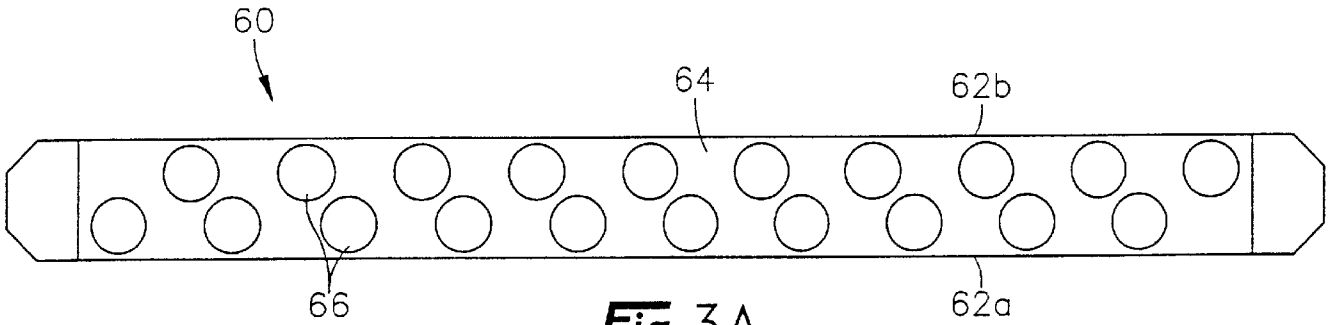
FIG. 3A is a plan view of a carriage of the present invention.
Figure 3B:
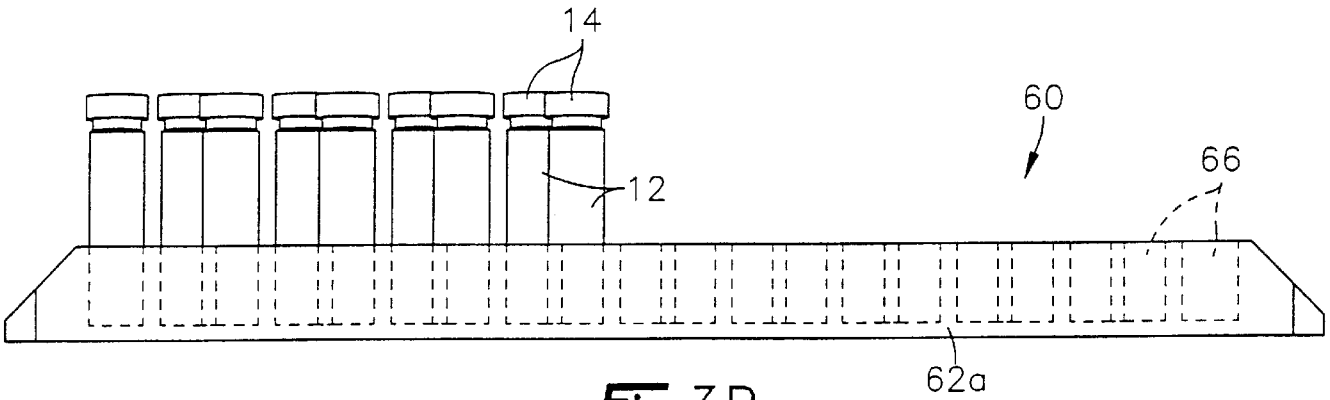
FIG. 3B is a side view of the carriage of the present invention.
Figure 3C:
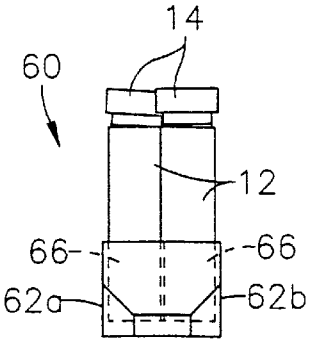
FIG. 3C is an end view of the carriage of the present invention.

The guidance apparatus 30 further includes a base 24, which has a rectangular-shaped member 32 to which is integrally formed two opposingly spaced abutment members 34*a* and 34*b* that form a receiving edge 36 therebetween. As is best shown in "Station A" of FIG. 1 and FIGS. 3A–C, a carriage 60 is provided for holding the vials 12. The carriage 60 is preferably is made of a rigid, non-porous plastic material and has two rows of ten receptacles 66 disposed therein for holding the vials 12. The receptacles 66 are disposed in a base 64, which is disposed between, and integrally formed with, two opposingly spaced side walls 62*a* and 62*b*. As is best shown in FIG. 3A, the rows of receptacles 66 are offset such that two of the receptacles 66 are in axial alignment with apertures 48*a* and 48*b* of the traverse carriage when the vials 12 contained in the two receptacles 66 are being filled with the substance.

In operation, the carriage 60, containing a plurality of vials 12 that do not have caps disposed thereon, is slid into place in the guidance apparatus 30 such that the carriage 60 abuts the receiving edge 36 during filling of the plurality of vials 12 with the substance. Preferably, the receiving edge 36 is of equal length to the longitudinal length of the carriage 60 for maintaining a tight fit of the carriage 60 against the receiving edge 36 while the vials 12 are being filled.

A stop member 26 is disposed in one of the opposingly spaced grooves 44*a* and 44*b* at each end of the guide member 42. The opposingly spaced grooves 44*a* and 44*b* provide beginning and ending set points along the guide member 42 and also prevent the traverse carriage 50 from sliding off the guide member 42.

Referring now to "Station B" of FIG. 1, the carriage 60 is shown with the plurality of vials 12 disposed therein and having caps 14 loosely disposed on each of the vials 12. In operation, after the vials 12 have been filled in "Station A", an operator or lab technician moves the carriage 60 to "Station B" and places the caps 14 on the vials 12, leaving the caps 14 in a loosened state.

Figure 4C:
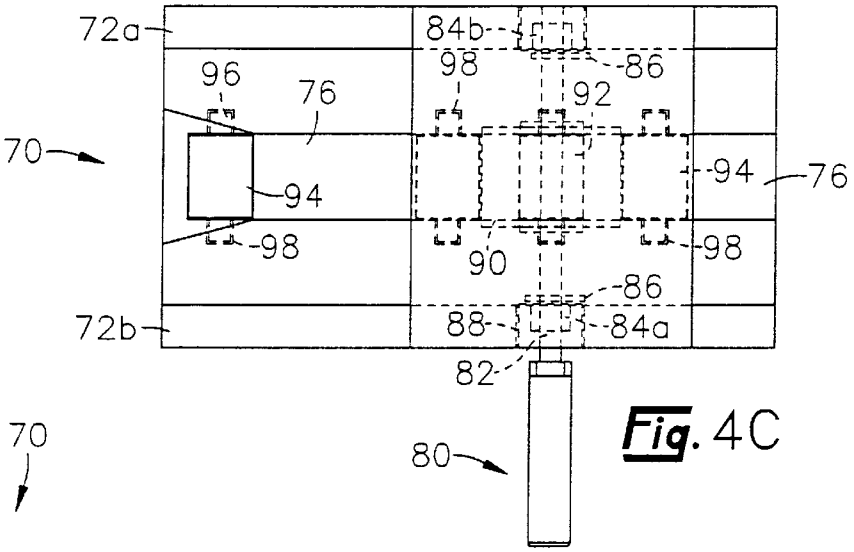
FIG. 4C is a plan view of the capping apparatus of the present invention.
Figure 4A:
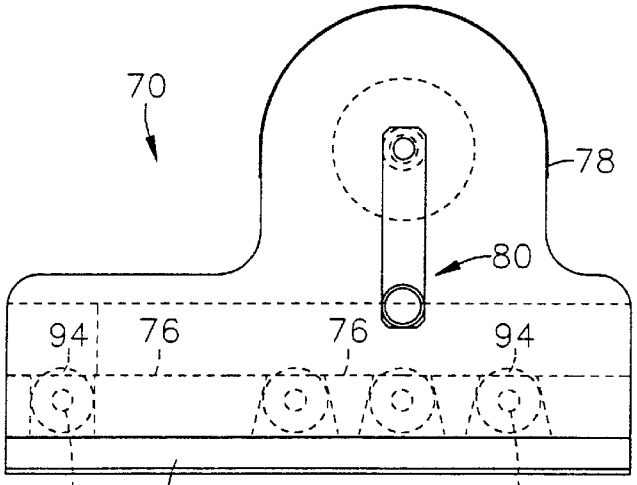
FIG. 4A is a side view of a capping apparatus of the present invention.
Figure 4B:
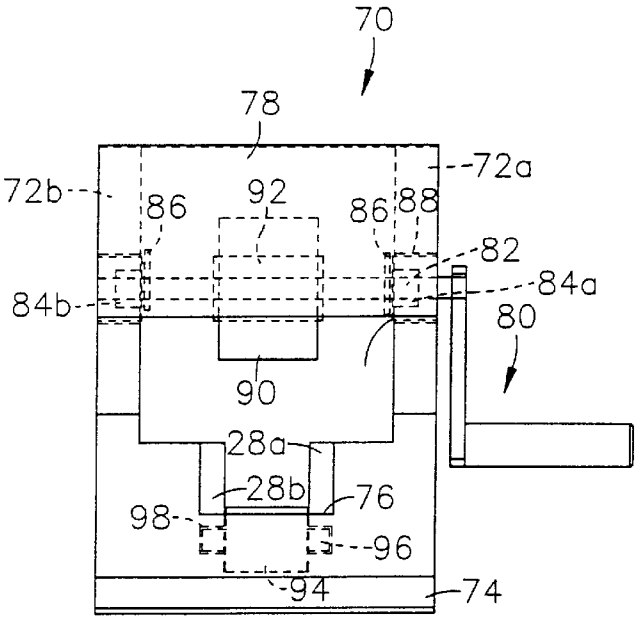
FIG. 4B is a front elevational view of the capping apparatus of the present invention.

Referring now to "Station C" of FIG. 1, once the vials 12 are loosely capped by the caps 14, the carriage 60 is placed in an apparatus 70 for securely mounting one of the caps 14 on at least one of the vials 12. As is best shown in FIGS. 4A–C, the apparatus 70 includes two side walls 72*a* and 72*b* secured to a base 74. A track 76 is mounted between, the side walls 72*a* and 72*b* and preferably is disposed above the base 74 for slidably receiving at least one vial 12 therein if the carriage 60 should not be used in the present invention or for slidably receiving the carriage 60 having at least one vial 12 disposed therein. If only one vial 12 is slid along track 76, or disposed in the carriage 60, the apparatus 70 will securely mount one of the caps 14 on the vial 12. Preferably, however, the carriage 60 will hold more than one vial 12 and all the vials 12 will be securely capped. Abutting each of the side walls 72*a* and 72*b*, and attached to the track 76, are channel guides 28*a* and 28*b* for keeping the vial 12 or carriage 60 on an axial path as it traverses through the apparatus 70. Partially covering the side walls 72*a* and 72*b*, and the track 76 is a cover plate 78, which houses a preferably rubber wheel 90. Wheel 90 is rotationally mounted between the two side walls 72*a* and 72*b* for simultaneously sliding the at least one vial 12 or carriage 60 along the track 76 and securely seating one of the caps 14 on the at least one vial 12 when the wheel 90 is rotated and contacts the cap 14.

In operation, when the wheel 90 comes in contact with one of the caps 14, forces are created in the downward direction to secure the cap 14 to the vial 12 because the capped vials 12 abut the wheel 90. Simultaneously the rotational force of the wheel 90 creates a force in the axial direction of the vial 12 or the carriage 60 that contains the vial 12, such that the vial 12 or carriage 60 is slid along the track 76. The wheel 90 is preferably rotated in the present invention by a hand crank 80, which is attached to a cross rod 82 that extends through the center of the wheel 90 and the two side walls 72*a* and 72*b*. It is understood, however, that wheel 90 could also be rotated by a motor. As shown in FIGS. 4B and 4C, a bore bearing 92 is contained in the center of the wheel 90 and attaches to the cross rod 82. To provide for a smooth rotation of the wheel 90 when the hand crank 80 is cranked, cam members 84*a* and 84*b* are disposed in corresponding side walls 72*a* and 72*b* of the apparatus 70 in rotational contact with the cross rod 82. The cam members 84*a* and 84*b*, and the cross rod 82 are contained within bores 88, which are disposed in each of the side walls 72*a* and 72*b*. To prevent the wheel 90 from sliding along the cross rod 82, pins 86 are inserted through the cross rod 82 on either side of the wheel 90 and the side walls 72*a* and 72*b*.

To aid in sliding of the carriage 60 or at least one of the vials 12, the track 76 includes at least one conveyor roller 94 that is rotationally mounted between the side walls 72*a* and 72*b* of the apparatus 70. Preferably, however, the track 76 includes four conveyor rollers 94, which are rotationally mounted between the side walls 72*a* and 72*b* on roller rods 96, which are disposed in notches 98 in the side walls 72*a* and 72*b* of the apparatus 70. The conveyor rollers 94 are preferably made of steel and are cam lifters from a Cummings diesel truck engine, while the roller rods 96 are preferably constructed of brass.

While the invention has been described in detail, it is to be expressly understood that it will be apparent to persons skilled in the relevant art that the invention may be modified without departing from the spirit of the invention. Various changes of form, design or arrangement may be made to the invention without departing from the spirit and scope of the invention. Therefore, the above mentioned description is to be considered exemplary, rather than limiting, and the true scope of the invention is that defined in the following claims.

What is claimed is:

1. An apparatus for securely mounting a cap on at least one vial, the apparatus comprising:

two opposingly spaced side walls;

a track mounted between a base and side walls for slidably receiving the at least one vial; and a wheel rotationally mounted between the two side walls for contacting the cap of the vial to simultaneously slide the at least one vial along the track and securely mount the cap on the at least one vial when the wheel is rotated.

2. The apparatus of claim 1 wherein the at least one vial is disposed in a carriage.

3. The apparatus of claim 2 wherein the carriage is slid along the track when the wheel is rotated and contacts the cap of the at least one vial.

4. The apparatus of claim 1 further including a hand crank attached to, and for manually rotating, the wheel.

5. The apparatus of claim 1 wherein the track further includes at least one conveyor roller rotationally mounted between the side walls for sliding the at least one vial along the track.

6. A guidance apparatus for filling a plurality of vials with a substance, the guidance apparatus comprising:

a guide member having a T-shaped track mounted there on and forming two opposingly spaced grooves; and an traverse carriage having a T-shaped channel formed therein, the T-shaped channel being defined by two opposingly spaced flanges for slidably engaging the two opposingly spaced grooves and for slidably moving the traverse carriage to set points along the guide member, and two opposingly spaced and offset apertures for receiving the substance therethrough, the two opposingly spaced and offset apertures each being in axial alignment with one of the plurality of vials at the set points as the traverse carriage is slid along the guide member for filling two of the plurality of vials at each of the set points with the substance.

7. The guidance apparatus of claim 6 further including a base wherein the guide member is mounted, the base having opposingly spaced abutment members forming a receiving edge therebetween.

8. The guidance apparatus of claim 7 wherein the plurality of vials are disposed in a carriage.

9. The guidance apparatus of claim 8 wherein the carriage abuts the receiving edge during filling of the plurality of vials with the substance.

10. The guidance apparatus of claim 6 wherein a stop member is disposed in one of the opposingly spaced grooves at each end of the guide member.

11. A system for securely mounting a plurality of caps on, and filling with a substance, a plurality of vials, the system comprising:

a guidance apparatus having a guide member with a T-shaped track mounted thereon and forming two opposingly spaced grooves, and an traverse carriage having a T-shaped channel formed therein, the T-shaped channel being defined by two opposingly spaced flanges for slidably engaging the two opposingly spaced grooves and for slidably moving the traverse carriage to set points along the guide member, the traverse carriage further including two opposingly spaced and offset apertures for receiving the substance therethrough, the two opposingly spaced and offset apertures each being in axial alignment with one of the plurality of vials at the set points as the traverse carriage is slid along the guide member for filing two of the plurality of vials at each of the set points with the substance; and a capping apparatus having two opposingly spaced side walls, a track mounted between the base and side walls for slidably receiving the plurality of vials, and a wheel rotationally mounted between the two side walls for simultaneously sliding the plurality of vials along the track and securely mounting the plurality of caps on the plurality of vials when the wheel is rotated and contacts at least one of the plurality of caps.

12. The system of claim 11 further including a carriage wherein the plurality of vials are disposed.

13. The system of claim 12 wherein the carriage is slid along the track when the wheel is rotated and contacts at least one of the caps.

14. The system of claim 11 further including a hand crank attached to, and for manually rotating, the wheel.

15. The system of claim 11 wherein the track further includes at least one conveyor roller rotationally mounted between the side walls for sliding the plurality of vials along the track.

16. The system of claim 12 wherein the guidance apparatus further includes a base wherein the guide member is mounted, the base having opposingly spaced abutment members forming a receiving edge therebetween.

17. The system of claim 16 wherein the carriage abuts the receiving edge during filling of the plurality of vials with the substance.

18. The system of claim 11 wherein the guidance apparatus further includes a stop member that is disposed in one of the opposingly spaced grooves at each end of the guide member.

* * * * *